US006752078B2

(12) United States Patent
Blanchard et al.

(10) Patent No.: US 6,752,078 B2
(45) Date of Patent: Jun. 22, 2004

(54) DEVICE FOR GUIDING FLAT OR SHEET-LIKE COPIES IN FOLDERS

(75) Inventors: Alain Blanchard, Gouvieux (FR); Franck Chagnon, Saint Leu d'Esserent (FR); Philippe Robin, Cires les Mello (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/078,116

(22) Filed: Feb. 19, 2002

(65) Prior Publication Data

US 2002/0112625 A1 Aug. 22, 2002

(30) Foreign Application Priority Data

Feb. 16, 2001 (DE) ..... 101 07 368

(51) Int. Cl.[7] ..... B41F 13/56

(52) U.S. Cl. ..... 101/226; 101/232; 101/227; 101/219; 101/224; 101/225; 101/226; 101/228; 493/400; 493/405; 493/357

(58) Field of Search ..... 101/232, 226, 101/227, 219, 224–228; 493/400, 405, 357

(56) References Cited

U.S. PATENT DOCUMENTS

| | | | | | |
|---|---|---|---|---|---|
| 3,518,940 | A | * | 7/1970 | Stroud | 101/223 |
| 4,069,959 | A | * | 1/1978 | Bartell et al. | 226/21 |
| 4,204,619 | A | * | 5/1980 | Damour | 226/21 |
| 4,441,390 | A | * | 4/1984 | Hechler et al. | 83/154 |
| 4,477,006 | A | * | 10/1984 | Sharp | 226/18 |
| 5,558,263 | A | * | 9/1996 | Long | 226/114 |
| 5,644,983 | A | | 7/1997 | Herrmann et al. | |
| 5,688,219 | A | | 11/1997 | Renard et al. | |
| 5,839,365 | A | | 11/1998 | Calbrix et al. | |
| 6,164,201 | A | * | 12/2000 | Burke | 101/228 |
| 6,195,112 | B1 | * | 2/2001 | Fassler et al. | 347/219 |
| 6,295,925 | B1 | * | 10/2001 | Sarni et al. | 101/228 |
| 6,349,867 | B1 | * | 2/2002 | Fernfors | 226/113 |
| 6,454,689 | B1 | * | 9/2002 | Voss | 493/11 |
| 6,513,427 | B2 | * | 2/2003 | Pautrat | 101/228 |

FOREIGN PATENT DOCUMENTS

| | | |
|---|---|---|
| DE | 1 248 066 | 8/1967 |
| DE | 2 132 827 | 3/1972 |
| DE | 41 28 864 A1 | 3/1993 |
| DE | 43 23 524 C2 | 1/1995 |
| DE | 196 00 379 A1 | 9/1996 |
| DE | 198 52 439 A1 | 6/1999 |
| DE | 199 49 223 A1 | 5/2000 |
| DE | 200 05 844 U1 | 8/2000 |
| DE | 100 00 507 A1 | 7/2001 |
| EP | 0 400 596 A2 | 12/1990 |
| FR | 2 751 630 A1 | 1/1998 |

* cited by examiner

*Primary Examiner*—Edward Lefkowitz
*Assistant Examiner*—Andrea H. Evans
(74) *Attorney, Agent, or Firm*—Laurence A. Greenberg; Werner H. Stemer; Gregory L. Mayback

(57) ABSTRACT

A device for guiding sheet-like copies which are severed from a material web in a cutting nip of a cutting-cylinder pair, including a copy guide disposed in an outlet wedge of the cutting-cylinder pair for gripping leading ends of the sheet-like copies for guiding the copies, the copy guide including revolving transport elements, and actuating drives for displacing the revolving transport elements in a lateral direction so as to adapt the transport elements to different positions and widths of material webs.

16 Claims, 7 Drawing Sheets

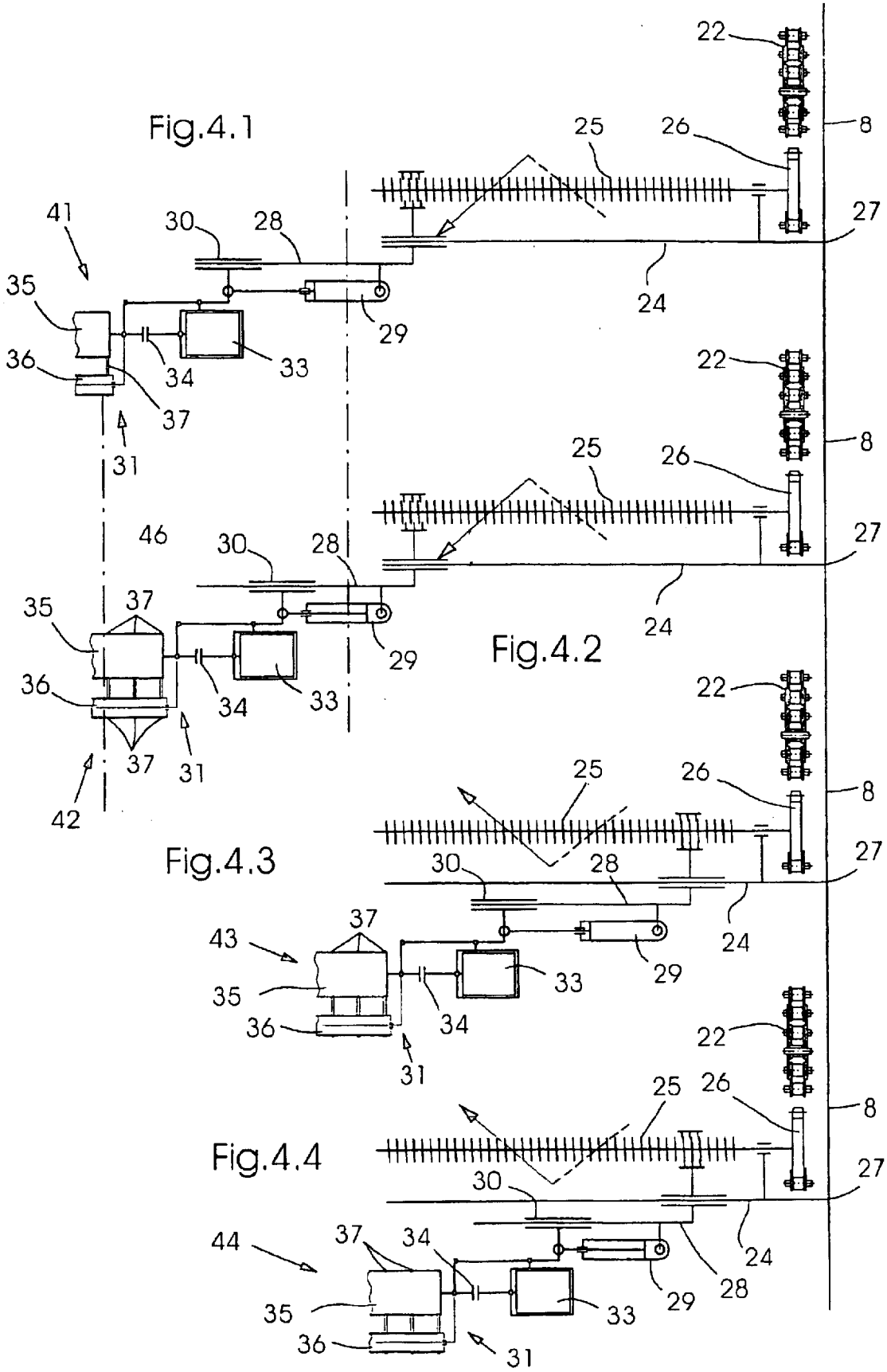
Fig.4.1
Fig.4.2
Fig.4.3
Fig.4.4
22
8
25
26
27
24
28
29
30
33
34
35
36
37
31
41
42
43
44
46

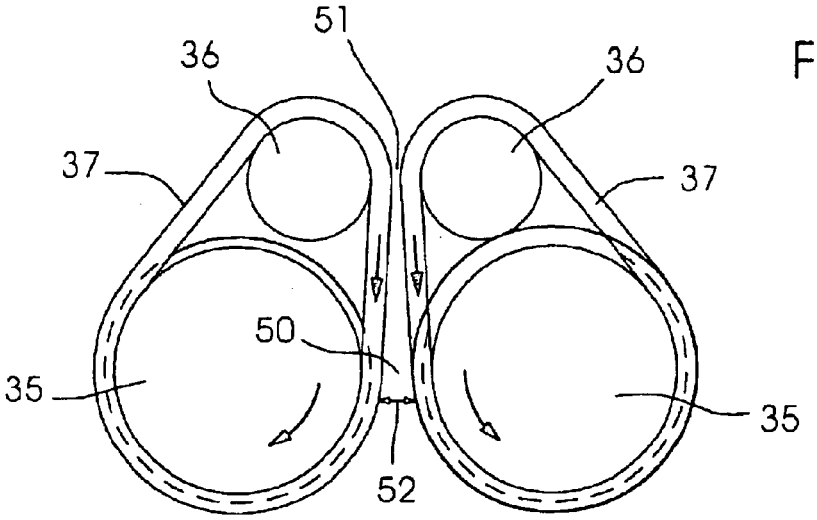
Fig.5.1
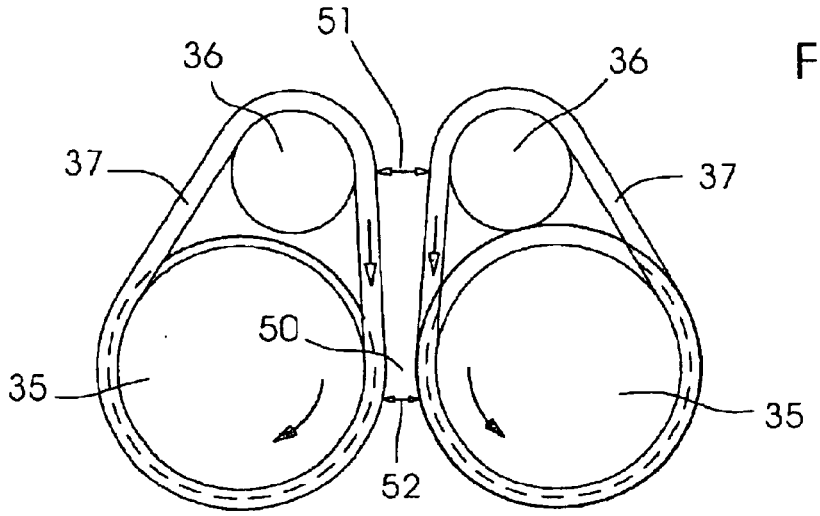
Fig.5.2
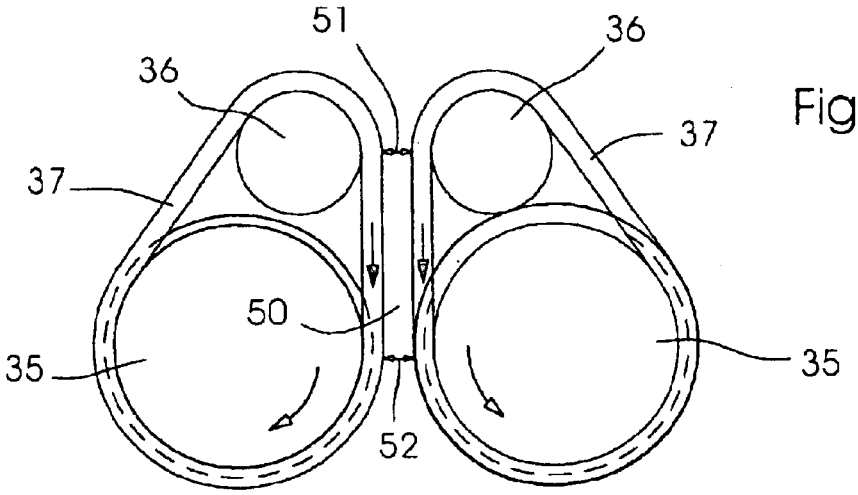
Fig.5.3

DEVICE FOR GUIDING FLAT OR SHEET-LIKE COPIES IN FOLDERS

BACKGROUND OF THE INVENTION

Field of the Invention

The invention relates to a device for guiding flat or sheet-like copies in folders, in particular such folded copies as are severed from a continuous material web.

In folders arranged downline in web-processing rotary printing machines, stationarily accommodated copy guides are arranged downline from a cutting nip of a cutting-cylinder pair. Such stationary copy guides are usually configured so that they correspond, with respect to the width thereof, to the width of the maximum processable web format and are configured, with respect to the extent of the guide nip thereof, so that the distance between the lateral surfaces bounding the guide nip corresponds to the thickness of a maximum processable material-web strand. With stationary copy guides arranged downline from a cutting nip of a cutting-cylinder pair, it is possible to guide a leading end of a material web through an outlet wedge of the cutting-cylinder pair into an inlet region with mutually cooperating transport belts, so that the copies severed from the material web in the cutting nip do not remain beyond control as they pass out of the outlet wedge of the cutting-cylinder pair into the inlet wedge of the downline transport-belt pair.

Stationary copy guides which are arranged downline from a cutting-cylinder pair encounter limitations with respect to the copy-guide quality that can be achieved therewith in the case of narrow web widths. In particular, when the width of the material web which is to be processed exceeds the width of stationary copy guides, stationary copy guides in the outlet wedge of a cutting-cylinder pair do not constitute a satisfactory solution. Furthermore, stationary copy guides do not allow individual adaptation of the guide surfaces to the thickness of the material-web strand; in addition, stationary copy guides cannot be removed readily from the installation region thereof downline from the cutting-cylinder pair. The hereinaforementioned stationary copy guides are described, for example, in the French Patent 2 751 630 or in U.S. Pat. No. 5,839,365.

Another possible construction, heretofore known from the published European Patent Document EP 0 400 596 A1, for improving copy guidance between a cutting nip of a cutting-cylinder pair and downline transport belts calls for providing between the transport-belt lines, on both sides of the incoming web, blowing or blast nozzles which are directed into the gap between the web and the cutting cylinder, and in arranging, on the circumferential surface of one of the cutting cylinders of the cutting-cylinder pair, annular grooves for a through-passage of the blowing or blast air. The blowing or blast air passing out of the blowing or blast nozzles is removed again to the greatest extent by suction nozzles assigned to the inlet region of the transport belts.

SUMMARY OF THE INVENTION

In view of the outlined developments heretofore known from the prior art, the object of the invention is to provide a copy guide for sheet-like copies that is adapted automatically to the respective material-web format which is to be processed and to the thickness of the material web, and can be set back from the outlet wedge of the cutting-cylinder pair.

With the foregoing and other objects in view, there is provided, in accordance with one aspect of the invention, a device for guiding sheet-like copies which are severed from a material web in a cutting nip of a cutting-cylinder pair, comprising a copy guide disposed in an outlet wedge of the cutting-cylinder pair for gripping leading ends of the sheet-like copies for guiding the copies, the copy guide including revolving transport elements, and actuating drives for displacing the revolving transport elements in a lateral direction so as to adapt the transport elements to different positions and widths of material webs.

In accordance with another feature of the invention, a respective copy guide is assigned to each side region of the material web.

In accordance with a further feature of the invention, a plurality of the copy guides arranged on both sides of the material web which is to be processed are displaceable symmetrically in relation to a machine center.

In accordance with an added feature of the invention, the copy guides arranged on both sides of the material web which is to be processed are displaceable independently of one another in relation to the machine center.

In accordance with an additional feature of the invention, to the copy guide there is assigned an actuating drive for positioning the copy guide within a displacement distance in a region of a side edge of the material web in accordance with the width of a copy.

In accordance with yet another feature of the invention, the copy guide includes pairwise driven rotary bodies and driving rotary bodies, about which the transport elements are revolvable.

In accordance with yet a further feature of the invention, the guiding device includes drives integrated in the copy guides for driving the driving rotary bodies.

In accordance with yet an added feature of the invention, each copy guide comprises an actuating cylinder for displacing a mount including rotary bodies into a position wherein the material web is gripped thereby, and into a position wherein the material web is not gripped thereby.

In accordance with yet an additional feature of the invention, pairs of the rotary bodies, respectively, are formed with a gap having a variable opening between the rotary bodies thereof.

In accordance with still another feature of the invention, the gap is bounded by the driven transport elements.

In accordance with still a further feature of the invention, the guiding device includes pivotable carriers wherein the driven rotary bodies are accommodated, relative to the rotary bodies, respectively, which drive them.

In accordance with still an added feature of the invention, the pivotable carriers are pivotable relative to the driving rotary bodies in order to vary the extent of opening of the gap.

In accordance with still an additional feature of the invention, the transport elements are configured as axially spaced-apart transport belts.

In accordance with another feature of the invention, the material web leaving the cutting nip is guidable by the transport elements on both sides of the material web, without any relative speed, along a gripping region.

In accordance with a further feature of the invention, the driven transport elements are arranged on mutually opposite sides of the material web as well as on both sides of the material web.

In accordance with a concomitant feature of the invention, there is provided a folder having a guiding device for guiding a material web in a cutting nip of a cutting-cylinder pair, wherein sheet-like copies are severed from the material web, the cutting-cylinder pair comprising a copy guide disposed in an outlet wedge of the cutting-cylinder pair for gripping leading ends of sheet-like copies severed from the web for guiding the copies, the copy guide including revolving transport elements, and actuating drives for displacing the revolving transport elements in a lateral direction so as to adapt the transport elements to different positions and widths of material webs.

The advantages of the embodiments according to the invention can be seen, in particular, in that the copies passing through the outlet wedge of the cutting-cylinder pair are now guided on both sides along a gripping region by conveying surfaces which are moved along as well, with the result that the situation wherein individual layers of a multilayered sheet-like copy flap open or become detached is effectively prevented as the copies pass through the outlet wedge of the cutting-cylinder pair, which is located downline from the cutting nip. Due to the driven transporting elements of the copy-guiding arrangement, the transporting elements being formed, for example, in belt form, the sheet-like copies can be guided through the outlet wedge into an inlet region of transport belts without any occurrence of disruptive relative speed. Furthermore, it is also possible for the copy guides, which are adjustable according to the invention relative to the material-web format which is to be processed, to be set back, or moved out, fully from the outlet wedge of a cutting-cylinder pair, with the result that the wedge is fully accessible for maintenance work, for example, for exchanging grooved bars and/or cutting knives.

In a preferred embodiment of the concept upon which the invention is based, a copy guide, respectively, is assigned to the side region of the material web. This makes it possible to achieve the situation wherein, in particular in the case of multilayered material webs, air enclosed in the region of the first longitudinal fold formed in the folder can be pressed out of the layers. Furthermore, the material web is prevented from flapping open at the open end by the copy-guiding arrangement assigned to the open end of a multilayered material web. Due to the engagement of the copy-guiding arrangement, which is assigned to the folding spine of the sheet-like copy, with the fold, the first longitudinal fold is formed with better quality even as the sheet-like copy passes through to the cylinder executing the actual cross-folding operations.

In order to increase the flexibility with respect to the processable web formats, it is possible for the copy guides arranged on both sides of the material web which is to be processed, respectively, to be displaced preferably both symmetrically in relation to the machine center and independently of one another in relation to the machine center. This takes into account the circumstance wherein, in the case of separate jobs, the material webs from which the individual copies are severed in the cutting nip of the cutting-cylinder pair do not always run centrally onto the cutting-cylinder pair. By means of the embodiments provided according to the invention, it is also possible for eccentrically guided material webs from which copies are severed to be gripped on both side regions during passage through the outlet wedge of the cutting-cylinder pair.

Each copy guide may advantageously have a first actuating drive assigned thereto by which the copy guide can be positioned highly accurately, within a displacement distance or spacing, against the side regions of the material web which is to be processed, the side regions being positioned in dependence upon the web format, respectively. The preferably stepless or infinite displaceability of the copy-guiding devices which is achieved in this way may be brought about, for example, via threaded spindles on which the copy-guiding arrangements are displaceably accommodated. Furthermore, each copy guide arranged on a side wall of the folder preferably comprises an actuating cylinder by which a copy-guide mount which comprises rotary bodies can be adjusted into a position wherein it grips the copy, and into a position wherein it does not grip the copy. In order to achieve extremely brief adjusting times between the active and the inactive positions of the respective copy guide, the actuating cylinder is preferably constructed as a pneumatic cylinder. The positioning, proposed according to the invention, of the copy guides against both sides of the material web which is to be processed thus makes it possible, first of all, for the copy guides to be positioned in a preliminary manner in accordance with the material-web width which is to be processed and, in a second step, for the transporting elements guiding the copies or the leading end of a material web to be advanced up to, or withdrawn from, the respective side regions at the open end and/or on the folding spine of the sheet-like copy. This likewise makes it possible for the copy-guiding arrangements, which are preferably formed by two rotary bodies which have an endless transport belt wrapped around them, to be moved out of the region of the outlet wedge very quickly by the activation of the actuating cylinder, in the case of a paper jam, in order to avoid damage.

In a preferred configuration, each copy guide comprises two pairs of rotary bodies each of which includes a driven rotary body and a driving rotary body, around which preferably belt-like transport elements revolve. In order for the sheet-like copy to be guided without any relative speed, the rotary bodies accommodated on the copy-guiding arrangements, preferably on both sides of the material web, are driven with the aid of drives integrated in the copy guide. These drives are preferably constructed as small electric motors, and drive the transport elements in a conveying direction of the sheet-like copies along the gripping region.

The transport elements are preferably configured in the form of belts and, spaced apart axially, are accommodated on the copy-guide rotary bodies which drive them. In order for the sheet-like copies passing through the outlet wedges to be handled as carefully as possible, the transport elements may be provided with friction-reducing coatings. The transport elements, which revolve around the rotary bodies of the copy guides, are preferably formed so that they grip the sheet-like copies on both sides along a vertically oriented gripping region.

In an advantageous configuration of the copy guides, a gap with a variable extent of opening is formed between the pairs of rotary bodies on the copy guides. The gap is bounded by the driven transporting elements, preferably configured in the form of belts, and, by pivoting of the driven rotary bodies, can be adjusted to a narrower or wider extent in relation to the driving rotary bodies. This may be necessary in order for the displaceable copy guides, formed in accordance with the invention, on both sides of the material web to be adapted in optimum fashion to the thickness, i.e., the number of layers of the material webs which are to be processed. In order to vary the extent of the gap in the region of the copy guides, the driven rotary bodies, around which the transport elements, preferably configured in the form of belts, revolve, are accommodated in pivotable carriers.

In a further embodiment of the concept upon which the invention is based, it is possible to arrange in an outlet wedge, arranged downline from a cutting nip of a cutting-cylinder pair, likewise revolving transport elements, which are preferably likewise constructed in the form of belts and can be driven directly via the deflecting rollers of the transport elements, with the result that the sheet-like copies leaving the cutting nip and/or the leading end of the material web are enclosed on both sides by belt-like transport elements and can be introduced into the inlet region of the transport belts without flapping open or deviating in some other way from the vertical transporting path.

The embodiment proposed in accordance with the invention comprises a positionable copy guide which operates without any relative speed in relation to the sheet-like copies and can preferably be used in folders of web-processing rotary printing machines. Folders arranged downline from the web-fed rotary printing machines may be combination folders and conventionally operating folders as well as folders operating without pins, it being possible for these to produce 48, 64 and 96-page copies.

Other features which are considered as characteristic for the invention are set forth in the appended claims.

Although the invention is illustrated and described herein as embodied in a device for guiding flat or sheet-like copies in folders, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIGS. 4.1 and 4.2 are fragmentary diagrammatic views of FIG. 2, showing, in active and inactive positions, respectively, a copy guide which has been engaged with the side edge of a material web having a minimally processable web width;

FIGS. 4.3 and 4.4 are views corresponding to those of FIGS. 4.1 and 4.2, showing, in the active and in the inactive positions, respectively, a copy guide which has been engaged with the side edge of a maximally processable web format;

FIGS. 5.1 to 5.3 are respective top plan views of revolving, copy-gripping transport elements, showing different opening gap geometries therebetween;

DESCRIPTION OF THE PREFERRED EMBODIMENTS

Figure 1:
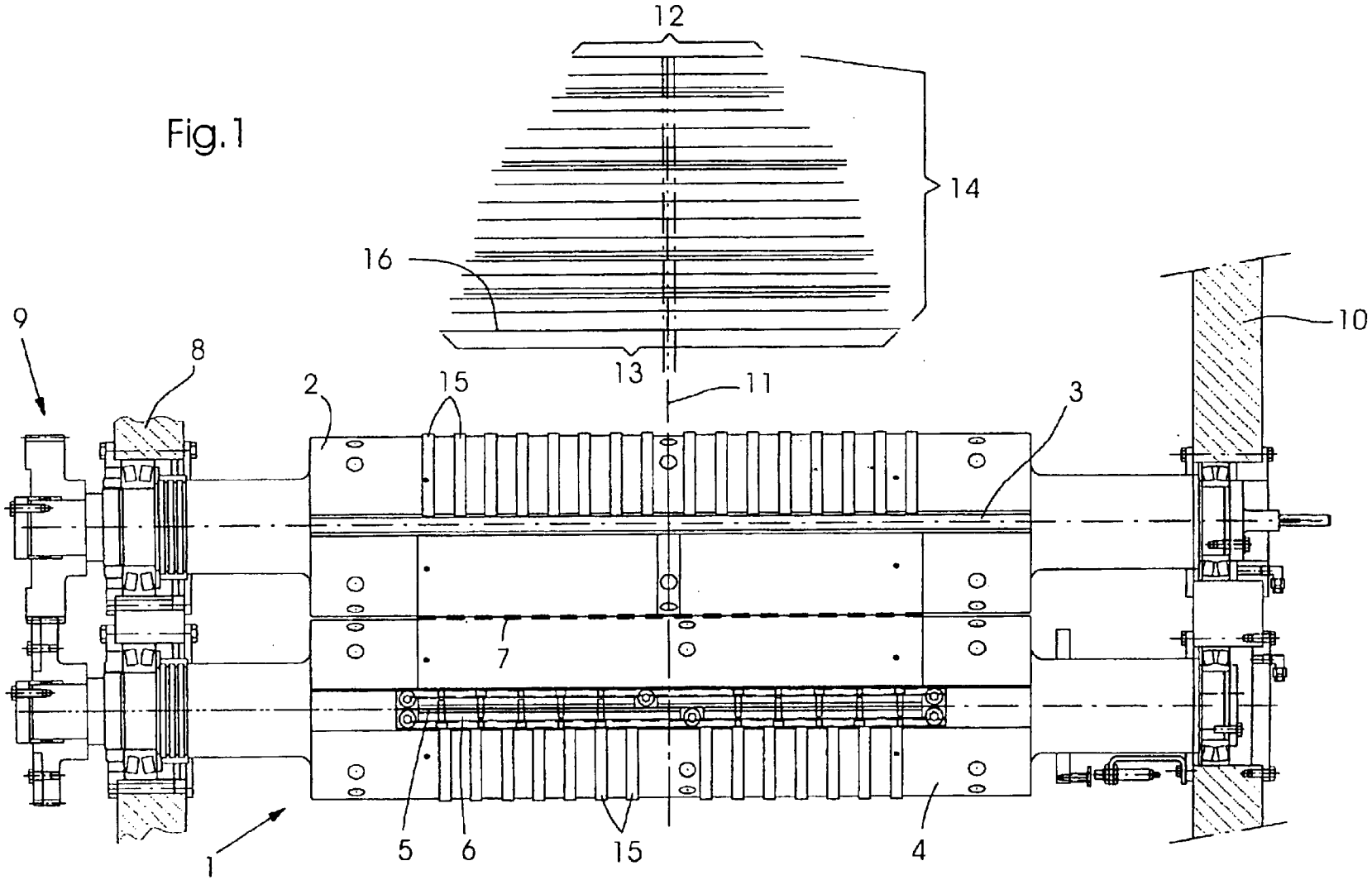
FIG. 1 is a plan view of a cutting-cylinder pair of a folder, and a diagrammatic representation of a multiplicity of web widths processable thereby.

Referring now to the drawings and, first, particularly to FIG. 1 thereof, there is shown therein, in a plan view, a cutting-cylinder pair of a folder, and a representation of a multiplicity of material-web widths which are processable on the cutting-cylinder pair.

The cutting-cylinder pair includes a grooved cylinder 2 and a cutting cylinder 4 bounding or defining a cutting nip 7 therebetween. A groove bar 3, preferably formed of elastic material, is introduced into the circumferential surface of the grooved cylinder 2. A cutting knife 5 is integrated in a knife mounting 6 on the circumferential surface of the cutting cylinder 4 and severs individual, sheet-like or flat copies from a leading end of a material web passing through the cutting nip 7. The grooved cylinder 2 and the cutting cylinder 4 are rotatably accommodated, via journals thereof, in roller bearings in side walls 8 and 10, respectively, of the folder. Provided on the drive-side side wall 8 of the folder is a drive, represented in FIG. 1 by gearwheels, via which the cylinders 2 and 3 of the cutting-cylinder pair 1 are set into rotation.

Arranged on the circumferential surfaces of the grooved cylinder 2 and of the cutting cylinder 4, according to FIG. 1, are ring segments 15 which provide the flat or sheet-like copies, severed from a leading end of the material web in the cutting nip 7, with a corrugated or wave-shaped reinforcement. The maximum material-web format which can be processed in the cutting nip 7 according to FIG. 1 is depicted at 13; the minimum material-web format is depicted at 12. Between the minimally processable web width 12 and the maximally processable web width 13 are a multiplicity of further web widths 14 which can pass through the cutting nip 7 of the cutting-cylinder pair 1 both symmetrically in relation to the machine center 11 and asymmetrically in relation thereto.

Figure 2:
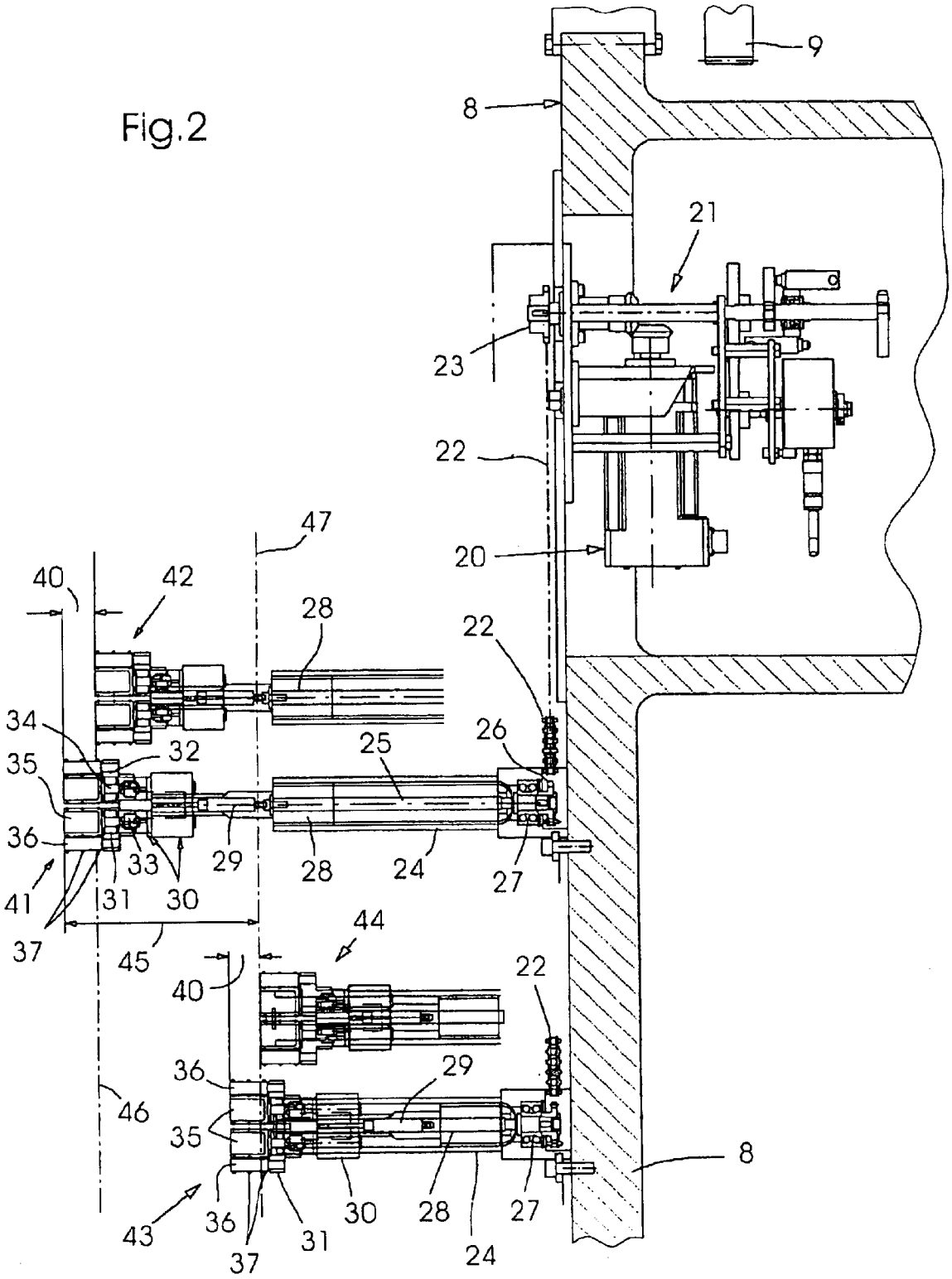
FIG. 2 is a side elevational view of a copy guide which is positionable dependent upon material web-width on a side wall of the folder, and grips side regions of the material webs which are to be processed.

FIG. 2 shows a web-width dependently positionable copy guide on a side wall of the folder, with which side regions of material webs which are to be processed are grippable. Flanged on the drive-side side wall 8 of a folder is an actuating drive which drives a sprocket wheel 23, for example, via a bevel gear mechanism 21. A chain 22 revolving around the sprocket wheel 23 functions as a transmission element, and transmits the rotary movement of the chain wheel 23 to a drive wheel 26 which, for its part, is accommodated, in a manner fixed against relative rotation, on a threaded spindle 25. The threaded spindle 25 is embedded in a bearing sleeve 24 so that it is rotatable on a spindle bearing 27. By the rotation of the threaded spindle 25, it is possible for an actuating-cylinder guide 28, which surrounds the spindle 25, to be retracted into the interior of the bearing sleeve 24 and extended from the interior of the bearing sleeve 24, respectively. Located on the actuating-cylinder guide 28 is an actuating cylinder 29, which is preferably constructed as a pneumatic cylinder. Located on the latter, in turn, is a mount 30 which accommodates the copy guide. Both the drives 33 for driven rotary bodies 35, configured as rollers, as well as a first carrier 31 and a second carrier 32 are received in the mount 30. Each of the carriers 31 and 32 accommodates a driving rotary body 35, driven via the drive 33, and a smaller-diameter, driven rotary body 36. Transport elements 37 revolve around the circumferential surface of the driving rotary body 35 and of the driven rotary body 36 and, according to FIG. 2, are configured as spaced-apart transport belts. The belt-like transport elements 37, which grip the side regions 46 of the material web 16, may be provided with a friction-reducing coating which ensures that the side regions 46 of the material web 36 are gripped carefully as the belt-like transport elements 37 act thereon.

The side edge 46 (note reference numeral 12 in FIG. 1) of the material web 16 has a minimal web width. In the position 41, the rotary bodies 35 and 36, respectively, and the transport belts 37 revolving around them, are located in an active position, i.e., a position wherein they grip the side region 46 of the material web 16. By being moved back a displacement distance 40, the copy guide formed in accordance with the invention, and provided with revolving transport elements 37, assumes an inactive position 42, i.e., is prevented from gripping the side region 46 of the material web 16 of minimal width 12. The actuating cylinder 29 which, for its part, is accommodated on the actuating-cylinder guide 28, serves For bridging the displacement distance 40 from the position 41 into the position 42. The engagement of a copy guide with a material web 16 of minimal width 12 and of maximal width 13, respectively, the side edge 47 of which is likewise shown in FIG. 2, is effected by the rotary movement of the spindles 25, which are enclosed by the bearing sleeves 24. The rotary movement initiated here, for example, by a chain drive 22, 23, 26, causes the rotary bodies 35 and 36, respectively, and the transporting elements 37 revolving around them, to be displaced the displacement distance 45, which is dimensioned so that all the common web widths can be gripped by the laterally positionable copy guide, which is formed, in accordance with the invention, with revolving transport elements 37.

The active and the inactive positions 43 and 44, respectively, of the copy guide are assumed thereby For bridging the displacement distance 40 from the position 41 into the position 42, during processing of the material web 16 of maximal web width 13. The latter is indicated by the side edge 47 of the material web shown in FIG. 2. Even in the case of a maximally processable web format, it is possible, via the actuating cylinder 29, to attain a displacement distance 40 for the rotary bodies 35 and 36, respectively, which are accommodated in pairs, respectively, on the copy guide. The advancement movement into the region of the web edge 47 takes place, in a manner analogous to the processing of the material web 16 of minimal web width 12, via the chain drive 22, 23, 26. The sprocket wheel 26 drives the threaded spindle, which is enclosed by the bearing sleeve 24 and on which the actuating-cylinder guide 28 is displaceably arranged and cooperates with the spindle 25.

Figure 3:
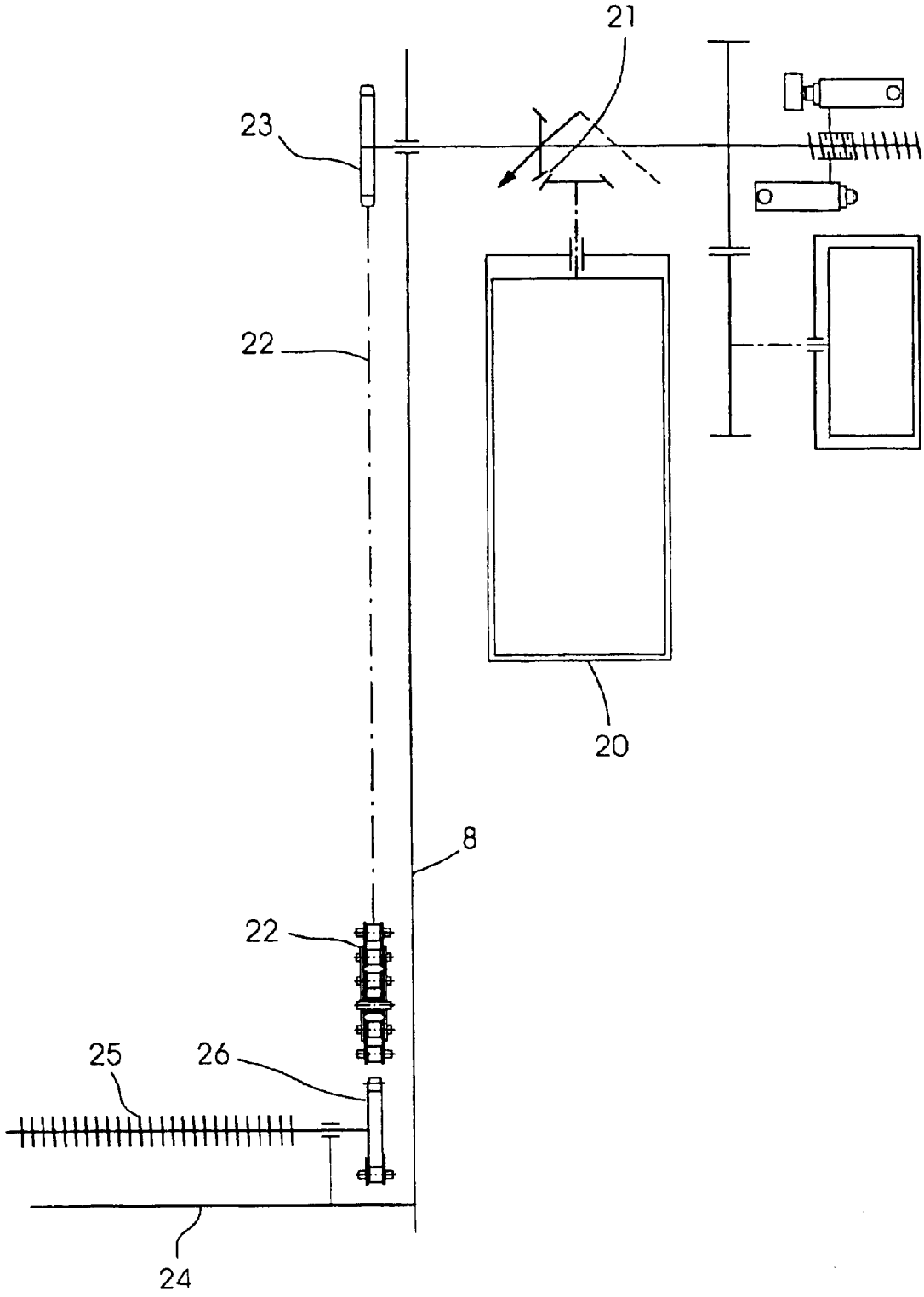
FIG. 3 is a fragmentary diagrammatic view of FIG. 2 showing a first actuating drive for web-width dependently positioning the copy guide.

FIG. 3 shows in greater detail a first actuating drive for web-width dependent positioning of the copy guide. FIG. 3 diagrammatically represents an actuating drive 20 which acts, via a bevel gear mechanism, on a shaft whereon a sprocket wheel 23 is formed. A chain, which functions as a drive-transmission element 22, drives a sprocket wheel 26 which, for its part, is accommodated on the spindle 25 which, for its part, is enclosed by the bearing sleeve 24, which is fastened to the drive-side side wall 8 of the folder.

Instead of a gear mechanism and a bevel gear mechanism, respectively, the spindles 25, which are enclosed by bearing sleeves 24, may also be driven directly via drive motors. In addition, it is also possible, instead of the chain drive represented diagrammatically in FIG. 3, for the threaded spindles 25 to be set into rotation via gearwheel drives or belt drives or the like. The rotary movement transmitted to the spindles 25, respectively, causes the actuating-cylinder guides 28, which accommodate the actuating cylinders 29, to be extended from the interior of the bearing sleeves 24 and retracted into the interior of the bearing sleeves 24, respectively.

FIGS. 4.1 and 4.2 diagrammatically show, both in the active and in the inactive positions, a copy guide which has been advanced onto or engaged with the side edge of a minimally processable web width. In FIG. 4.1, the copy guide formed in accordance with the invention has been adjusted into an active position 41, i.e., it grips an edge 46 of a material web 16 of minimal web width 12. By the threaded spindle 25, the actuating-cylinder guide 28 can be adjusted relative to the bearing sleeve 24. FIG. 4.1, merely representing the kinematics, also shows that the mount 30 is displaced in relation to the actuating-cylinder guide 28 by the actuating cylinder 29, which is represented here in the extended, i.e., active, position, in order, for example, for the rotary bodies 35, 36 to be moved back in a very short period of time, within less than one second, in the case of a paper jam, in order to avoid damage. On the mount 30 according to FIG. 4.1, only the first carrier 31 is represented here, it being possible for this first carrier 31 to be moved relatively to the mount 30. Also accommodated on the mount 30 is an electric motor 33 which, with the interposition of a coupling 34, drives the rotary body 35. The rotary body 36 is entrained or moved along by the transport elements 37, preferably transport belts, surrounding the circumferential surface. Three axially spaced-apart transport elements 37, for example, are accommodated on the circumferential surfaces of the rotary bodies 35 and 36, respectively. In contrast, according to FIG. 4.2, the actuating cylinder 29 has been adjusted into a retracted position. As a result, the mount 30 has been moved back on the actuating-cylinder guide 28 in a direction towards the side wall 8 of the folder. The rotary bodies 35 and 36, respectively, accommodated on the first carrier 31, together with the transport elements 37 revolving on the circumferential surface of the rotary bodies, have thus been moved away from the web edge 46, i.e., they do not grip the edge, which corresponds to an inactive position 42. In comparison with FIG. 4.1, there has been no change in the position of the actuating-cylinder guide 28 in relation to the bearing sleeve 24 and the threaded spindle 25 passing through the latter, respectively. The changeover, in accordance with the displacement distance 40 shown in FIG. 2, from the active position 41 into the inactive position 42 thus takes place exclusively via the actuating cylinder 29, which is fixedly connected to the actuating-cylinder guide 28 that is moved via the threaded spindle 25.

FIGS. 4.3 and 4.4 show in greater detail, both in the active and in the inactive positions, a copy guide which has been engaged with the side edge of a material web having a maximally processable web width.

In contrast with the hereinaforedescribed FIGS. 4.1 and 4.2, the actuating-cylinder guide 28, in relation to the bearing sleeve 24, has been moved back closer to the drive-side side wall 8 of the folder. This makes it possible for the copy guide 31, 35, 36 to be positioned in relation to an edge 47 of a material web 16 of maximal web width 13. In the active position 43, the belt-like transport elements 37, which revolve around the rotary bodies 35 and 36, grip the side region of a material web 16 formed in this way. Analogously to FIGS. 4.1 and 4.2, respectively, the driven rotary body 35 is connected to a drive motor 33 via a coupling element 34. For illustrative reasons, only the first carrier 31 is represented in FIGS. 4.1, 4.2 and 4.3 and in FIG. 4.4, a larger-diameter rotary body 35 and a smaller-diameter, driven rotary body 36 being accommodated in a rotatable manner on the first carrier. Also accommodated on the mount 30 (note FIG. 2) is a second carrier 32 (not illustrated here), whereon a larger-diameter rotary body 35 and a smaller-diameter, driven rotary body 36 are likewise accommodated, the belt-like transport elements 37 revolving around the rotary bodies.

FIG. 4.4 shows the copy-guiding arrangement according to the invention in an inactive position 44, i.e., set back from the edge 47 of the material web 16 of maximum web width 13. Even in a set-back, i.e., inactive, position 44, the position of the actuating-cylinder guide 28 in relation to the bearing sleeve 24 and the spindle 25 enclosed by the latter, is identical with the positions of these components according to FIG. 4.3. What has taken place is only that the actuating cylinder 29 has moved the mount 30 on the actuating-cylinder guide 28 back in the direction towards the driving-side side wall 8 of the folder, as a result of which the rotary bodies 35 and 36, together with the transporting elements 37 revolving around them, have been set back from the edge 47 of the material web 16 of maximal web width 13.

FIGS. 5.1, 5.2 and 5.3 show different opening-gap geometries which can be adjusted between the revolving, copy-gripping transport elements of the copy guide configured according to the invention.

FIG. 5.1 shows the driven rotary bodies 35, the drive motor 33 of which being not illustrated therein. The belt-like transport elements 37, preferably three in number, revolve around the circumferential surface of the driven rotary bodies 35. The rotary elements 35, which are set into rotation by the drive motor 33, drive, via revolving transport elements 37, the smaller-diameter rotary elements 36 accommodated, above the transport elements, respectively, on the first carrier 31 and the second carrier 32. The preferably belt-like transport elements 37 revolve in counterclockwise direction, as viewed in FIG. 5.1, and provide the sheet-like copies passing into an opening gap or nip 50 between the surfaces thereof, or the leading end of the material web, with a conveying movement in the copy-movement direction, i.e., downwardly in FIGS. 5.1 to 5.3. In the state illustrated in FIG. 5.1, the rotary bodies 36 are spaced apart from one another at an upper distance or spacing 51, which is preferably dimensioned to be smaller than a lower distance or spacing 52 between the lower rotary bodies 35 in FIG. 5.1. This stems from the fact that the rotary bodies 36 are preferably mounted on pivotably mounted first and second carriers 31 and 32, respectively, in the mount 30, the pivot axis of which coincides with the axis of rotation of the rotary bodies 35.

The arrangement according to FIG. 5.2 shows that, besides the upper distance or spacing 51 illustrated in FIG. 5.1, it is also possible to have a greater distance or spacing 51 between the rotary bodies 36 by suitable pivoting of the first and the second carriers 31, 32, respectively, about the pivot axes thereof, so that altogether an outwardly opening funnel-shaped gap 50 is formed and is favorable for gripping multilayered material webs. The lower distance or spacing 52 between the driven rotary bodies 36 is at least approximately identical with the distance or spacing 52 shown in FIG. 5.1.

The arrangement according to FIG. 5.3 shows that, due to the pivoting of the first and the second carriers 31, 32, respectively, about the pivot axes thereof coinciding with the axes of rotation of the rotary bodies 35, it is also possible to adjust an opening-gap geometry 50 which is defined by an identical upper distance or spacing 51 and a thus identical lower distance or spacing 52.

Figure 6:
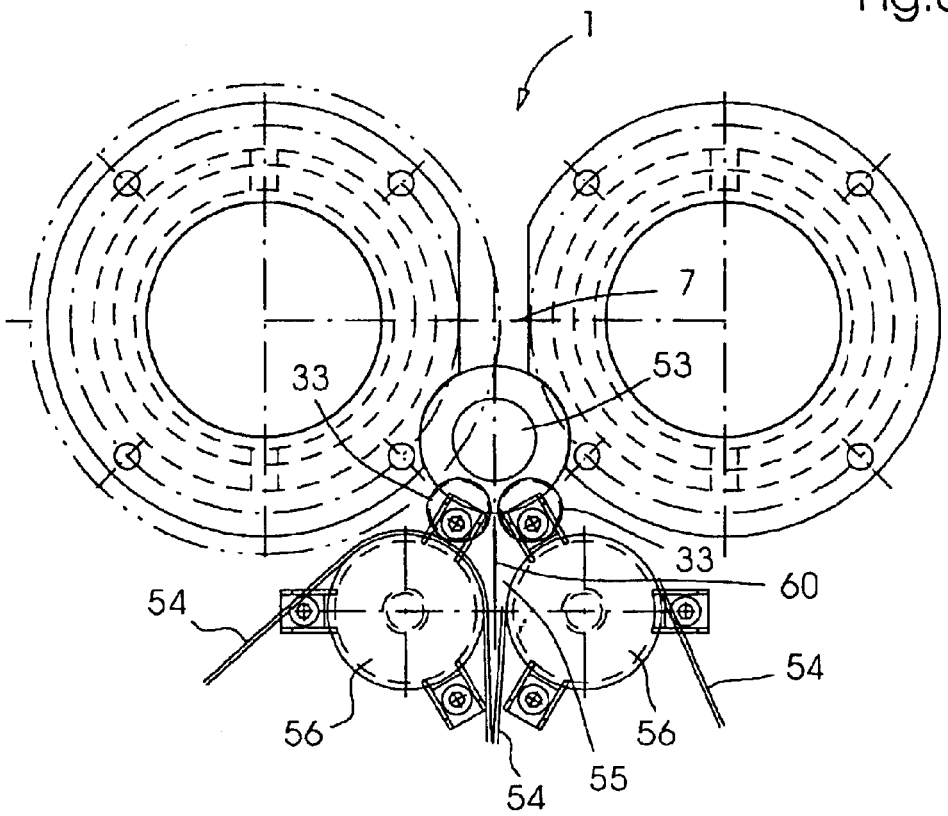
FIG. 6 is a side elevational view of the cutting-cylinder pair with transport belts arranged downline from the outlet wedge thereof.

FIG. 6 is a side view of a cutting-cylinder pair with transport belts arranged downline from the outlet wedges thereof.

Arranged downline from the cutting nip 7 of the cutting-cylinder pair according to FIG. 6 is an outlet wedge 53 into which the leading end of the material web 16 passes. The leading end of the material web 16 runs into an inlet region 55 which is bounded by transport belts 54. The copy guide 31, 32, 35, 36 proposed in accordance with the invention supports the trouble-free, i.e., guided, entry of the leading end of the material web 16 into the inlet region 55 between the transport belts 54, before a sheet-like copy is severed from the material web 16 by a cross cut occurring in the cutting nip. In FIG. 6, drive motors 33 are provided for the larger-diameter rotary bodies 35.

Figure 7:
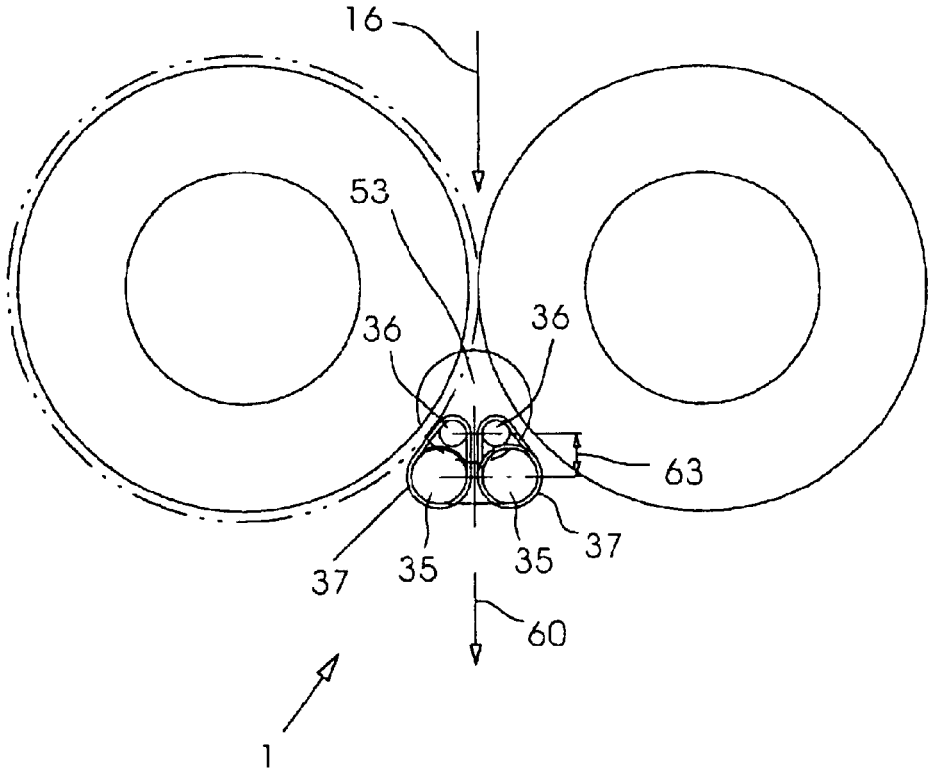
FIG. 7 is a side elevational view of the copy guide positioned in the outlet wedge of the cutting-cylinder pair and having driven, revolving transport elements.

FIG. 7 shows the copy guide, positioned in the outlet wedge of the cutting-cylinder pair, with driven, revolving transport elements.

This illustration clearly shows that, due to the configuration of the larger-diameter rotary bodies 35 and of the smaller-diameter rotary bodies 36, the copy guide proposed in accordance with the invention may be positioned in the outlet wedge 53 at a very short distance from the cutting nip 7 of the cutting-cylinder pair 1. This means that, by using the device according to the invention, the leading end of a material web 16 can be gripped early enough. The transport elements which revolve around the rotary bodies 35 and 36, and are preferably formed as belts, ensure that the leading end of the material web 16 which passes through the cutting-cylinder pair is guided, immediately after it has passed through the cutting nip 7, via a gripping region 63, which preferably extends downwardly in vertical direction, but may, however, likewise run horizontally.

Because the transport elements 37, which revolve around the rotary bodies 35 and 36, respectively, are preferably driven at machine speed, it is possible for the leading end 16 of the material web and, following completion of the cross cut in the cutting nip 7, for a sheet-like copy 60, respectively, to be conveyed largely without any relative speed.

Figure 8:
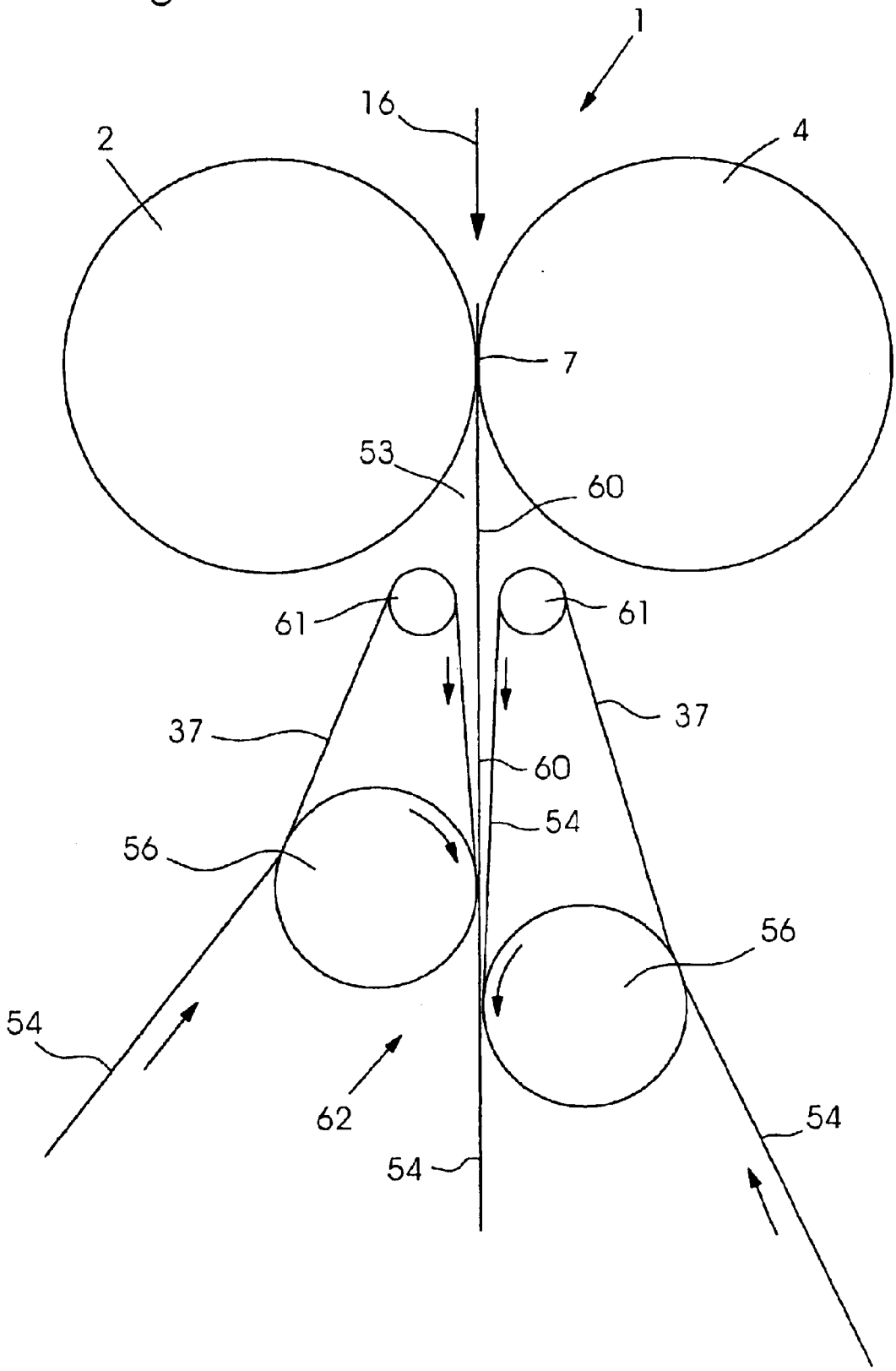
FIG. 8 is a diagrammatic side elevational view of a different embodiment of the copy guide according to the invention, with revolving transport elements directly driven by transport belts.

FIG. 8 shows a different embodiment of the copy guide according to the invention, with revolving transport elements driven by transport belts.

According to the embodiment of the invention shown in FIG. 8, an outlet wedge 53 of a cutting-cylinder pair 1 has assigned thereto revolving, preferably belt-like transport elements 37. In contrast with the embodiments of the invention outlined hereinbefore, these transporting elements 37, however, are driven directly via deflecting or diverting rollers 56, which serve likewise for driving the transport belts 54 which are adjacent to the outlet wedge 53. The deflecting rollers 56 are in an offset arrangement 62 relative to one another in FIG. 8. By providing small-diameter deflecting rollers 61, it is also possible, according to this embodiment of the concept upon which the invention is based, for transporting elements 37 which grip the copies 60 and the leading end of the material web 16, respectively, to be arranged as close as possible to the cutting nip 7 in the outlet wedge 53 of the cutting-cylinder pair 1, which includes the grooved cylinder 2 and the cutting cylinder 4. The conveying direction of the revolving, preferably belt-like transport elements 37 is identical with the conveying direction of the leading end of the material web 16 and of the sheet-like copy 60, respectively. Due to this embodiment of the concept upon which the invention is based, it is likewise possible for the leading end of the material web 16 and the sheet-like copy 60, respectively, to be enclosed on both sides. The revolving transport elements 37, which are preferably driven at a speed at least approximately corresponding to the conveying speed of the material web 16 and of the sheet-like copies, respectively, cause the outsides of the sheet-like copy 60 and of the leading end of the material web 16, respectively, to be gripped without any relative speeds, with the result that is no damage occurs to the severed copies 60.

We claim:

1. A device for guiding sheet-like copies which are severed from a material web in a cutting nip of a cutting-cylinder pair, comprising a copy guide disposed in an outlet wedge of the cutting-cylinder pair for gripping leading ends of the sheet-like copies for guiding the copies, said copy guide including revolving transport elements, and actuating drives for displacing said revolving transport elements in a lateral direction so as to adapt said transport elements to different positions and widths of material webs.

2. The guiding device according to claim 1, wherein a respective copy guide is assigned to each side region of the material web.

3. The guiding device according to claim 2, wherein a plurality of the copy guides arranged on both sides of the material web which is to be processed are displaceable symmetrically in relation to a machine center.

4. The guiding device according to claim 2, wherein the copy guides arranged on both sides of the material web which is to be processed are displaceable independently of one another in relation to the machine center.

5. The guiding device according to claim 1, wherein to the copy guide there is assigned an actuating drive for positioning the copy guide within a displacement distance in a region of a side edge of the material web in accordance with the width of a copy.

6. The guiding device according to claim 1, wherein the copy guide includes pairwise driven rotary bodies and driving rotary bodies, about which said transport elements are revolvable.

7. The guiding device according to claim 6, including drives integrated in said copy guides for driving said driving rotary bodies.

8. The guiding device according to claim 6, wherein each copy guide comprises an actuating cylinder for displacing a mount including rotary bodies into a position wherein the material web is gripped thereby, and into a position wherein the material web is not gripped thereby.

9. The guiding device according to claim 6, wherein pairs of said rotary bodies, respectively, are formed with a gap having a variable opening between the rotary bodies thereof.

10. The guiding device according to claim 9, wherein said gap is bounded by said driven transport elements.

11. The guiding device according to claim 9, including pivotable carriers wherein said driven rotary bodies are accommodated, relative to the rotary bodies, respectively, which drive them.

12. The guiding device according to claim 11, wherein said pivotable carriers are pivotable relative to said driving rotary bodies in order to vary the extent of opening of said gap.

13. The guiding device according to claim 1, wherein said transport elements are configured as axially spaced-apart transport belts.

14. The guiding device according to claim 1, wherein the material web leaving the cutting nip is guidable by said transport elements on both sides of the material web, without any relative speed, along a gripping region.

15. The guiding device according to claim 1, wherein said driven transport elements are arranged on mutually opposite sides of the material web and on both sides of the material web.

16. A folder having a guiding device for guiding a material web in a cutting nip of a cutting-cylinder pair, wherein sheet-like copies are severed from the material web, comprising a copy guide disposed in an outlet wedge of the cutting-cylinder pair gripping leading ends of sheet-like copies severed from the web for guiding the copies, said copy guide including revolving transport elements, and actuating drives for displacing said revolving transport elements in a lateral direction so as to adapt said transport elements to different positions and widths of material webs.

* * * * *